US005690385A

United States Patent [19]

Feldman et al.

[11] Patent Number: 5,690,385

[45] Date of Patent: Nov. 25, 1997

[54] ROTATABLE SUN CHAIR

[76] Inventors: Jerry Feldman, 1071 Lakeshore Dr., Jupiter, Fla. 33458; Larry Brandow, 348 Honbart Ave., Absecon, N.J. 08201

[21] Appl. No.: 689,162

[22] Filed: Aug. 7, 1996

[51] Int. Cl.[6] ..... A47C 1/14

[52] U.S. Cl. ..... 297/344.26; 297/217.2; 297/188.01; 297/378.1

[58] Field of Search ..... 297/344.26, 344.21, 297/344.22, 217.2, 188.01, 217.7, 378.1, 411.28

[56] References Cited

U.S. PATENT DOCUMENTS

| | | | |
|---|---|---|---|
| 1,822,638 | 9/1931 | Aiello | 297/188.01 |
| 1,829,614 | 10/1931 | Schier | 297/217.2 X |
| 2,163,078 | 6/1939 | Zerbee | 297/411.44 X |
| 2,671,631 | 3/1954 | Fox | 297/344.26 X |
| 3,151,910 | 10/1964 | Larson | 297/344.22 |
| 3,235,250 | 2/1966 | Doerr | 297/344.22 X |
| 3,905,642 | 9/1975 | Simjian | 297/344.26 X |
| 4,720,140 | 1/1988 | Change, III | 297/344.26 X |
| 5,097,549 | 3/1992 | Swing | 5/417 |
| 5,211,172 | 5/1993 | McGuane et al. | 297/217.7 X |
| 5,358,307 | 10/1994 | Shafer et al. | 297/188.01 X |
| 5,395,157 | 3/1995 | Rollo et al. | 297/344.26 |
| 5,421,637 | 6/1995 | Lemburg | 297/188.01 |

FOREIGN PATENT DOCUMENTS

| | | | |
|---|---|---|---|
| 820475 | 11/1951 | Germany | 297/344.26 |
| 125627 | 7/1949 | Sweden | 297/344.21 |

*Primary Examiner*—Peter M. Cuomo
*Assistant Examiner*—David E. Allred
*Attorney, Agent, or Firm*—Norman St. Landau

[57] ABSTRACT

A rotatable sun chair (10) which comprises two independent, cooperating circular members, a first base member (12) and a second base member (14), one being rotatably mounted over the other. A foldable chair (16), reclinable to a variety of predetermined positions, is collapsibly housed in the middle portion of the device. The device further has a sun dial (18) comprising a vertically disposed sun dial needle (18A) and sun dial display (18B) facing the front end of the chair (16). At least one storage receptacle, hollowed from the first base member (12) functions to receive sunglasses, lotion and various other necessities. During portage, the device is collapsed to a generally disc-like configuration, enabling the same to be easily and conveniently carried, transported or stored. The rotatable sun chair (10) is preferably manufactured from a lightweight, rust-proof material such as plastic, plastic composite, rubber, or resin. In an alternative embodiment, the rotatable sun chair comprises a plurality of storage compartments, integrally displaced with a portion of the circular base.

7 Claims, 4 Drawing Sheets

ROTATABLE SUN CHAIR

BACKGROUND OF THE INVENTION

1. Field of the Invention

The present invention relates to a rotatable sun chair. More particularly, the present invention provides a collapsible reclining beach chair having a circular, rotating base which enables the chair to be repositioned to face any direction.

2. Description of the Prior Art

One of the most common, irritating and inconvenient dilemmas one encounters at a beach or park is the constant need to reposition one's beach or lawn chair. This problem is particularly acute for sun bathers, who need to continually face the sun for any number of hours in order to obtain optimal color. The use of a conventional beach or lawn chair requires one to frequently stand and reposition the chair accordingly. This superfluous activity is compounded when the chair is not positioned properly and the user must again rise to move the chair. Another problem associated with the use of a conventional beach or lawn chair arises when a strong wind is present, causing the chair to be blown away when not in use. One must occasionally run significant distances to retrieve an unbounded chair. Numerous improvements have been made to remedy the above problems, however, said improvements fall short of the intended objectives of the present invention as hereinafter discussed.

Numerous innovations for a rotatable sun chair have been provided in the prior art that are adapted to be used. Even though these innovations may be suitable for the specific individual purposes to which they address, they would not be suitable for the purposes of the present invention as heretofore described.

SUMMARY OF THE INVENTION

In accordance with the present invention, a rotatable sun chair includes a circular base comprising two independent, cooperating circular members, one being rotatably mounted over the other. A folding chair, reclinable to a variety of positions, is collapsibly disposed in the middle portion of the device. The device further has a sun dial comprising a vertically displaced needle and corresponding time display, integrally attached to the circular base. At least one storage receptacle, grooved within the top portion of the circular base, enables soft drinks, sunglasses, lotion and various other necessities to be conveniently stored. During portage, the device is collapsed to a generally disc-like configuration, enabling the same to be easily and conveniently carried, transported or stored. The rotatable sun chair is preferably manufactured from a lightweight, rust-proof material such as plastic, plastic composite, rubber, or resin. In an alternative embodiment, the rotatable sun chair comprises a plurality of storage compartments, integrally displaced with the circular base.

Accordingly, it is an object of the present invention to provide a rotatable sun chair which comprises a rotatable member which enables one to simply and efficiently reposition a chair to any desired direction.

More particularly, it is an object of the present invention to provide a rotatable sun chair which comprises an adjustably mounted chair, which can be raised or lowered to various desired angles, and which is collapsible within the base of the device when not in use.

Another feature of the present invention is that the rotatable sun chair is manufactured from lightweight, rust-proof materials which allow the device to be easily carried or moved, and which prolong the life of the device by preventing rust or corrosion from diminishing the use and functionality of the same.

Yet another feature of the present invention is that the device includes a sundial which is easily viewable from the chair, precluding the need for the user to bring a watch or other timepiece.

Another feature of the present invention is that the device is collapsible to a generally disc-like configuration, enabling the same to be transported or stored in a variety of convenient locations.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—rotatable sun chair (10)
12—first base member (12)
12A—first base member top (12A)
12AA—first base member storage means (12AA)
12AB—first base member chair housing (12AB)
12B—first base member edge (12B)
12C—first base member bottom (12C)
12CA—first base member bottom pin (12CA)
14—second base member (14)
14A—second base member top (14A)
14B—second base member edge (14B)
14C—second base member bottom (14C)
14CA—second base member bottom aperture (14CA)
16—chair (16)
16A—chair back (16A)
16BL—chair left arm (16BL)
16BR—chair right arm (16BR)
16BLA—chair left arm rod (16BLA)
16BLB—chair left arm pin (16BLB)
16BRA—chair right arm rod (16BRA)
16BRB—chair right arm pin (16BRB)
18—sun dial (18)
18A—sun dial needle (18A)
18B—sun dial display (18B)
20—duct (20)
20A—duct guide member (20A)
20B—plurality of duct balls (20B)

BRIEF DESCRIPTION OF THE PREFERRED EMBODIMENT

DETAILED DESCRIPTION OF THE PREFERRED EMBODIMENT

Figure 1:
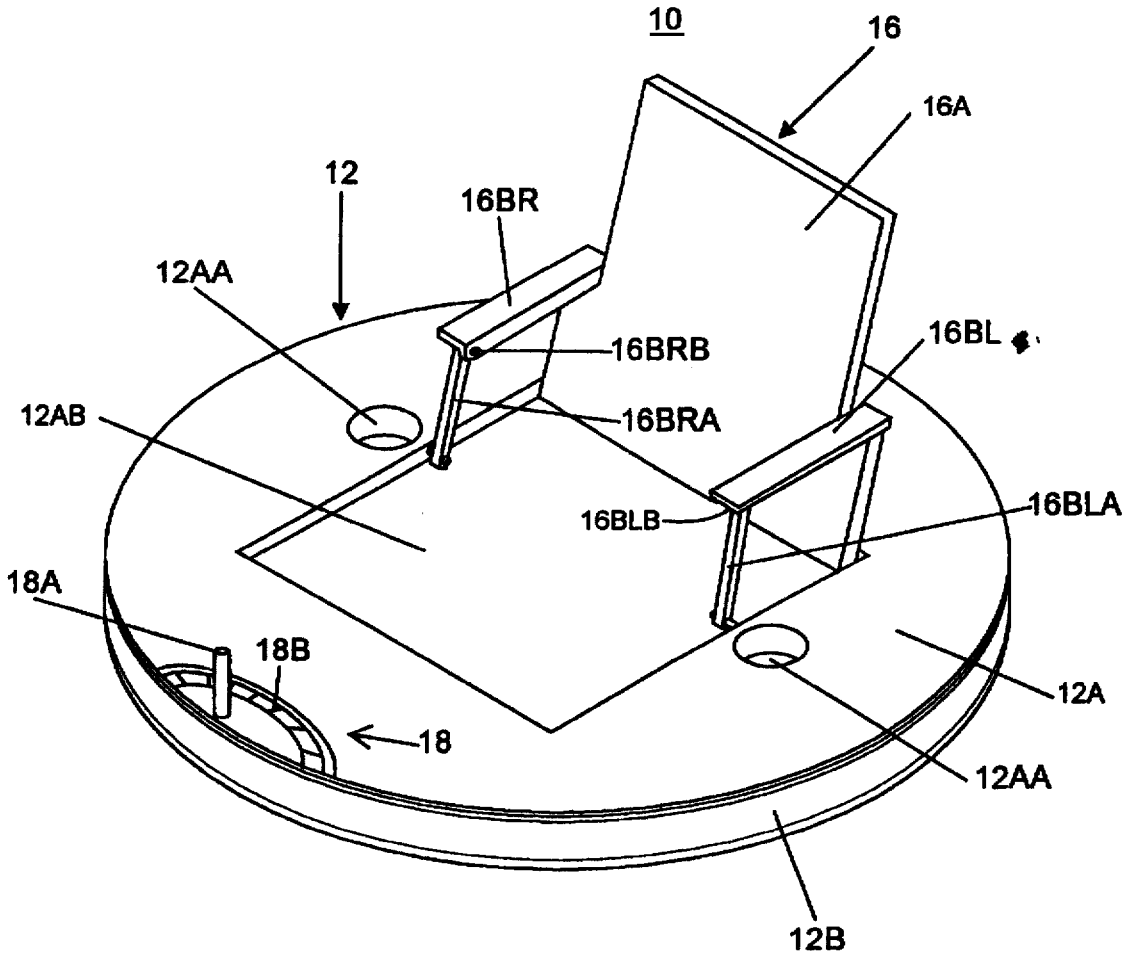
FIG. 1 is a top perspective view of the rotatable sun chair.

Firstly, referring to FIG. 1 which is a top perspective view of the rotatable sun chair (10) exhibiting the following features: first base member (12); first base member top (12A); first base member storage means (12AA); first base member chair housing (12AB); first base member edge (12B); first base member bottom (12C); first base member bottom pin (12CA); second base member (14); second base member top (14A); second base member edge (14B); second base member bottom (14C); second base member bottom aperture (14CA); chair (16); chair back (16A); chair left arm (16BL); chair right arm (16BR); chair left arm rod (16BLA); chair left arm pin (16BLB); chair right arm rod (16BRA); chair right arm pin (16BRB); sun dial (18); sun dial needle (18A); sun dial display (18B); duct (20); duct guide member (20A); and a plurality of duct balls (20B). The rotatable sun chair (10) comprises two generally flat, overlapping circular members, a first base member (12) and a second base member (14). The first base member (12) is rotatably mounted over the second base member (14) which remains in a fixed position during usage. The first base member (12) has a first base member top (12A) and a first base member bottom (12C) which have a generally flat configuration. The middle portion of the first base member bottom (12C) forms a first base member bottom pin (12CA) which protrudes downwardly from the first base member (12). The leading edge of the first base member (12) forms a first base member edge (12B) which extends downwardly around the circumference of the first base member (12). The first base member (12) is rotatably mounted directly over the second base member (14), which has a slightly smaller size than the first base member (12). The second base member (14) has a second base member top (14A) and a second base member bottom (14C), which have a generally flat configuration. A second base member aperture (14CA), hollowed through the middle of the second base member (14), forms an opening through which the first base member bottom pin (12CA) is insertable. The leading edge of the second base member (14) forms a second base member edge (14B) which extends upwardly around the circumference of the second base member (14). During usage, the first base member (12) can be rotated to any point in a 360 degree circumference.

A foldable chair (16) is collapsibly disposed toward the middle portion of the first base member (12). The chair (16) comprises a chair left arm (16BL) and a chair right arm (16BR), each having one distal end pivotally mounted to a chair back (16) by means of a chair left arm pin (BLB) and a chair right arm pin (16BRB), respectively. The opposite distal ends of the chair left arm (16BL) and the chair right arm (16BR) are pivotally mounted to a chair left arm rod (16BLA) and a chair right arm rod (16BRA), by means era chair left arm pin (BLB) and a chair right arm pin (16BRB), respectively. The chair left arm rod (16BLA) and the chair right arm rod (16BRA) are pivotally mounted to the first base member (12). The mid-section of the first base member (12) is slightly hollowed to form a first base member chair housing (12AB) which conforms to the dimensions of the chair back (16A), the chair left arm (16BL) and the chair right arm (16BR). When not in use, the chair (16) is collapsible and is securely stored within the first base member chair housing (12AB)

Figure 2:
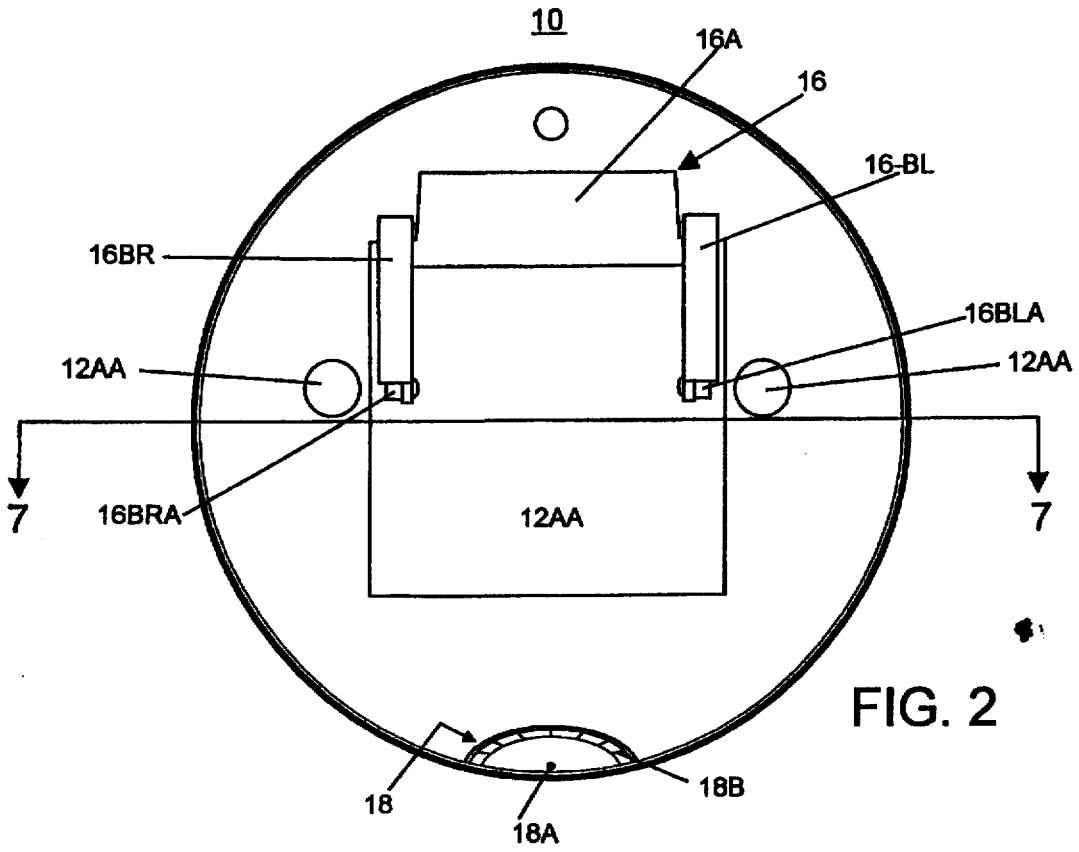
FIG. 2 is a top view of the rotatable sun chair.

Now referring to FIG. 2 which is a top view of the rotatable sun chair (10) with the chair (16) in an upright position. A sun dial (18), situated directly in front of the chair (16), functions as a time piece. The sun dial (18) comprises a vertically disposed sun dial needle (18A) which is secured to the first base member (12) and a sun dial display (18B) comprising a plurality of inscribed numbers. The first base member (12) further includes at least one first base member storage means (12AA) hollowed therein. The at least one first base member storage means (12AA) forms a generally cylindrical housing and is intended for the storage of such items as soft drinks, sunglasses, tanning lotion and keys.

Figure 3:
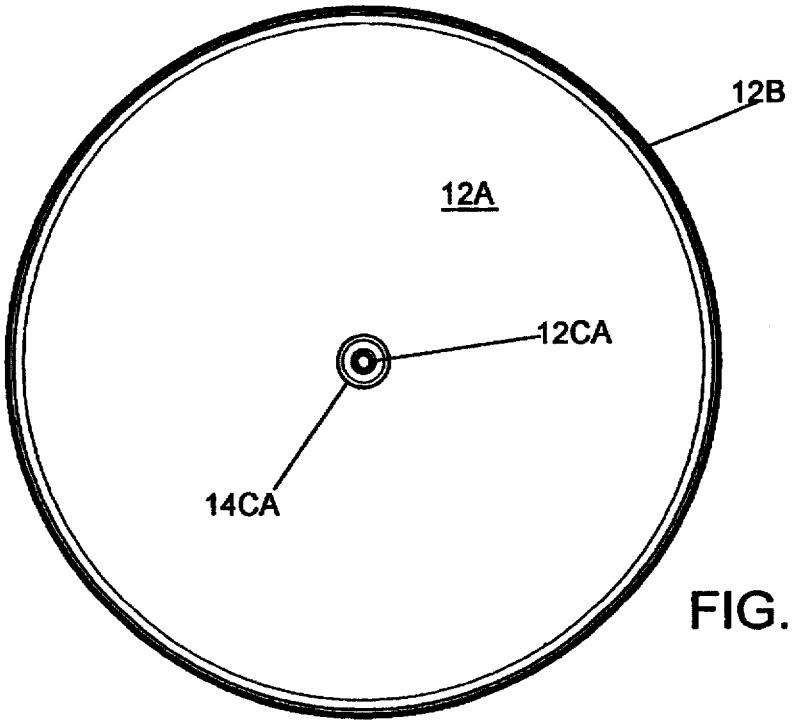
FIG. 3 is a top view of the rotatable sun chair exhibiting the first base member pin and the second base member aperture.

Now referring to FIG. 3 which is a top view of the rotatable sun chair (10) exhibiting the first base member pin (12CA) and the second base member aperture (14CA). The first base member pin (12CA) is rotatably housed within the second base member aperture (14CA), enabling the first base member (12) to rotate over the second base member (14) without the same being dislodged.

Figure 4:
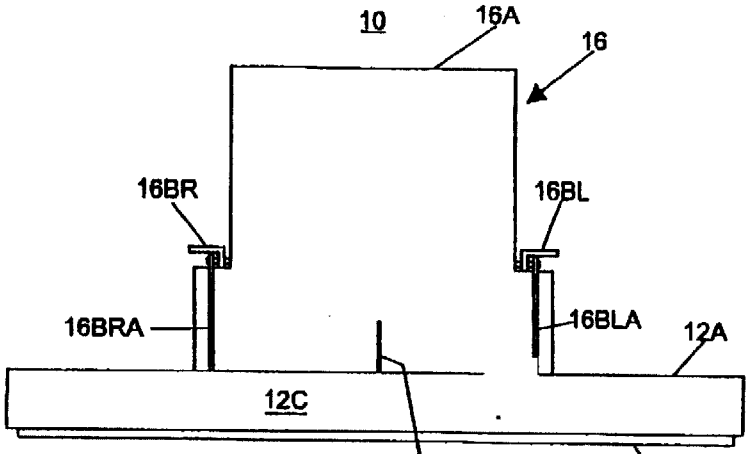
FIG. 4 is a front view of the rotatable sun chair.

Now referring to FIG. 4 which is a front view of the rotatable sun chair (10) exhibiting the chair (16) in an upright position.

Figure 5:
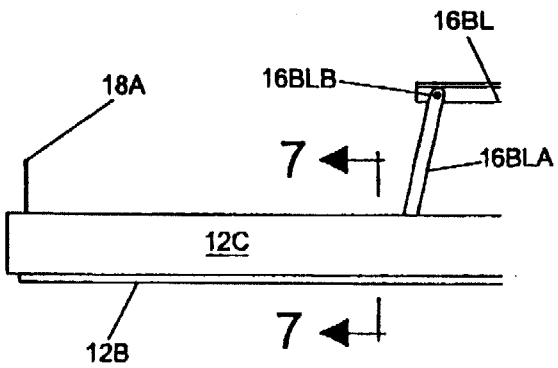
FIG. 5 is a side view of the rotatable sun chair.

Now referring to FIG. 5 which is a side view of the rotatable sun chair (10).

Figure 6:
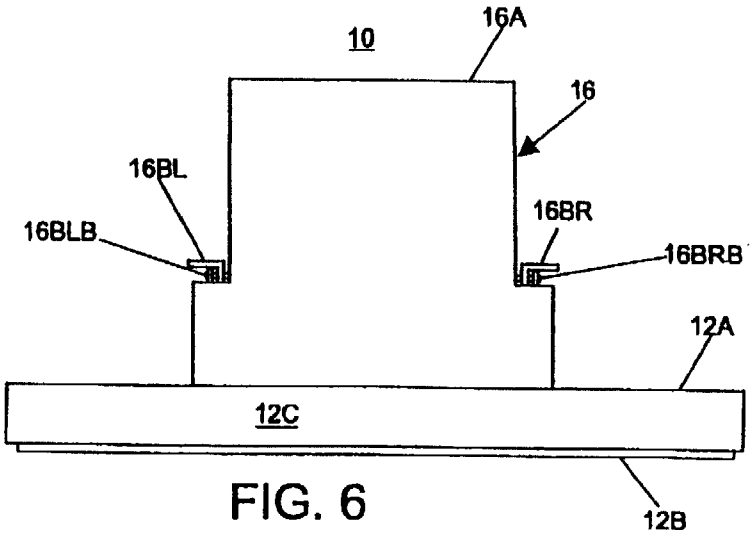
FIG. 6 is a back view of the rotatable sun chair.

Now referring to FIG. 6 which is a back view of the rotatable sun chair (10).

Figure 7:
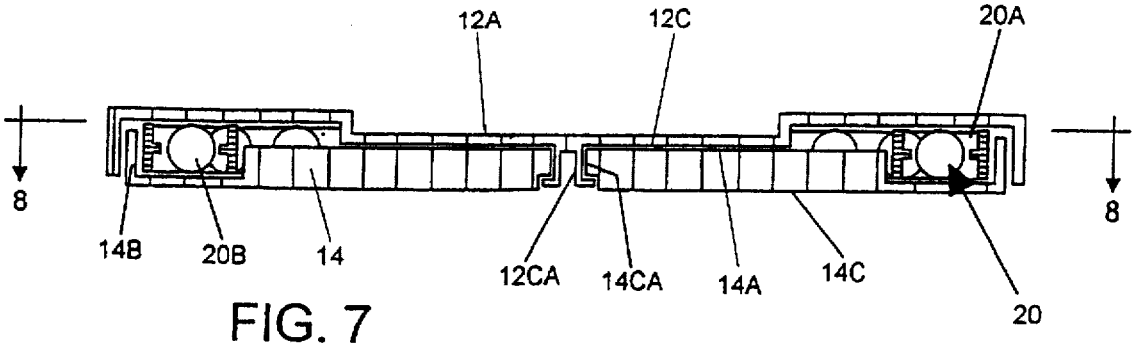
FIG. 7 is a cross-sectional side view of the rotatable sun chair.

Now referring to FIG. 7 which is a cross-sectional side view of the rotatable sun chair (10). As discussed hereinbefore, the first base member (12) is rotatably mounted over the second base member (14), and is secured thereon by means of the first base member pin (12CA) which is rotatably housed within the second base member aperture (14CA). The outer edge of the first base member (12) is slightly raised and the corresponding outer edge of the second base member (14) is slightly hollowed to form a duct (20) which extends around the circumference of the first base member (12) and the second base member (14). The duct (20) forms a generally rectangular, closed channel and includes a duct guide member (20A) which lines either side of the duct (20). A plurality of duct balls (20B), having a size slightly less than that of the duct (20), move freely within the duct (20). The movement of the plurality of duct balls (20B) is controlled by the duct guide members (20A), which protrude outwardly toward the mid-section of the plurality of duct balls (20B). The plurality of duct balls (20B) function as ball bearings, which ensure the fluid motion of the first base member (12) over the second base member (14).

Figure 8:
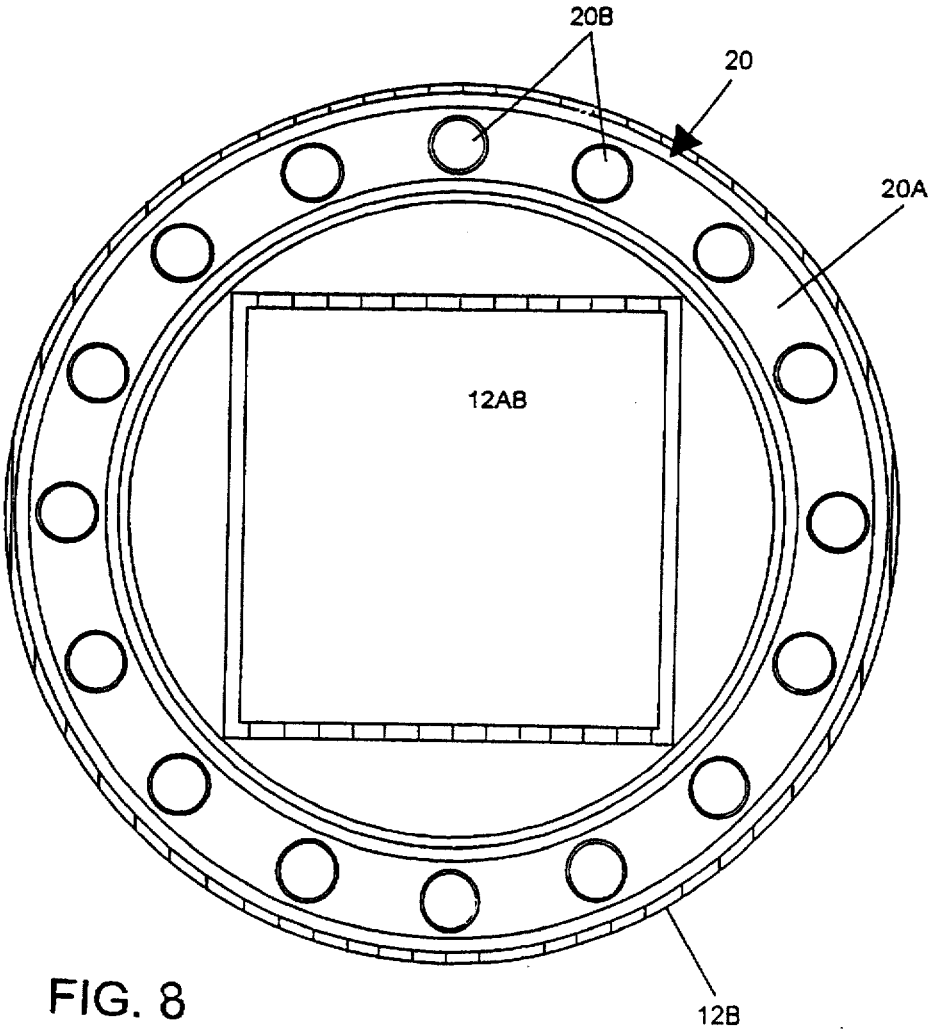
FIG. 8 is a cross-sectional top view of the rotatable sun chair.

Now referring to FIG. 8 which is a cross-sectional top view of the rotatable sun chair (10) and exhibiting the plurality of duct balls (20B).

It will be understood that each of the elements described above, or two or more together, may also find a useful application in other types of constructions differing from the type described above.

While the invention has been illustrated and described as embodied in a rotatable sun chair, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A rotatable sun chair (10) comprising:

A) a circular first base member (12) comprises a first base member top (12A) and a first base member bottom (12C), a leading edge of the first base member (12) forms a first base member edge (12B) extending downwardly therefrom, the first base member (12) further comprises at least one first base member storage means (12AA) hollowed therein for storing objects, a middle of the first base member bottom (12C) forms a first base member bottom pin (12CA) protruding downwardly therefrom, the first base member (12) further comprises a sun dial (18) having a vertically disposed sun dial needle (18A) and a sun dial display (18B) inscribed thereon, a mid-section of the first base member (12) is slightly recessed to form a first base member chair housing (12AB) with a chair back (16A) mounted therein;

B) a circular second base member (14) disposed beneath and encased within the first base member (12) comprises a second base member top (14A) and a second base member bottom (14C), the leading edge of the second base member (14B) forms a second base member edge (14B) extending upwardly from the second base member (14), a second base member bottom aperture (14C) forms an opening in a mid-section of the second base member (14) through which the first base member bottom pin (12CA) is inserted, a duct (20) is formed from an open channel created between the first member (12) and the second member (14), the duct (20) includes a duct guide member (20A) disposed in the duct (20) which further includes a plurality of duct balls (20B) movably contained therein; and C) a chair (16) having a chair left arm (16BL) and a chair right arm (16BR) pivotally connected to said chair back (16A) on one distal end by means of a chair left arm pin (16BLB) and a chair right arm pin (16BRB), respectively, the opposite distal ends of the chair left arm (16BL) and the chair right arm (16BR) are pivotally mounted to a chair left arm rod (16BLA) and a chair right arm rod (16BRA), respectively, by means of a chair left arm pin (16BLB) and a chair right arm pin (16BRB), and said chair right arm rod (16BRA) and said chair left arm rod (16BLA) are each mounted in said chair housing (12AB).

2. The rotatable sun chair (10) as described in claim 1, wherein the device is manufactured from resin, rubber, plastic and plastic composite.

3. The rotatable sun chair (10) as described in claim 1, wherein the chair (16) is collapsible to fit within the first base member chair housing (12AB).

4. The rotatable sun chair (10) as described in claim 2, wherein the chair (16) is reclinable.

5. The rotatable sun chair (10) as described in claim 1, wherein the first base member (12) is rotatably mounted over the second base member (14).

6. The rotatable sun chair (10) as described in claim 1, wherein the first base member storage means (12AA) functions as a storage facility for a plurality articles including glasses, lotion, keys, portable phones and radios, beverage containers and jewelry.

7. The rotatable sun chair (10) as described in claim 1, wherein the plurality of duct balls (20B) function as ball bearings, enabling the first base member (12) to rotate freely and easily over the second base member (14).

* * * * *